US008348379B2

(12) United States Patent
Shinozaki

(10) Patent No.: US 8,348,379 B2
(45) Date of Patent: Jan. 8, 2013

(54) IMAGE FORMING APPARATUS

(75) Inventor: Kenichi Shinozaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 81 days.

(21) Appl. No.: 13/009,109

(22) Filed: Jan. 19, 2011

(65) Prior Publication Data

US 2011/0181657 A1 Jul. 28, 2011

(30) Foreign Application Priority Data

Jan. 26, 2010 (JP) ..... 2010-014796

(51) Int. Cl.
*B41J 2/165* (2006.01)

(52) U.S. Cl. ..... 347/30

(58) Field of Classification Search ..... 347/29, 347/30

See application file for complete search history.

(56) References Cited

U.S. PATENT DOCUMENTS

| | | | | |
|---|---|---|---|---|
| 4,270,544 | A * | 6/1981 | Gilden et al. | 600/392 |
| 6,039,432 | A * | 3/2000 | Fukuoka | 347/32 |
| 2006/0007262 | A1 * | 1/2006 | Huang | 347/29 |
| 2009/0051735 | A1 | 2/2009 | Takahashi et al. | |

FOREIGN PATENT DOCUMENTS

| | | |
|---|---|---|
| JP | 6-126947 | 5/1994 |
| JP | 2002-127463 | 5/2002 |
| JP | 2005-199549 | 7/2005 |
| JP | 2007-290243 | 11/2007 |
| JP | 4149821 | 7/2008 |
| JP | 2009-45870 | 3/2009 |

* cited by examiner

*Primary Examiner* — Shelby Fidler
*Assistant Examiner* — Alexander D Shenderov
(74) *Attorney, Agent, or Firm* — Cooper & Dunham LLP

(57) ABSTRACT

A disclosed droplet discharge apparatus includes a droplet discharge head; a head sealing member that is disposed so as to face the droplet discharge head and that is moved to a position where a surface of the droplet discharge head is sealed off from outside of the head sealing member; and a suction force generator that generates a suction force inside the head sealing member. Further, the head sealing member moves droplets remaining on a nozzle surface of the droplet discharge head along the nozzle surface and suctioning as well as suctioning ink from a nozzle surface of the droplet discharge head.

9 Claims, 17 Drawing Sheets

IMAGE FORMING APPARATUS

CROSS-REFERENCE TO RELATED APPLICATIONS

The present application claims priority under 35 U.S.C §119 based on Japanese Patent Application No. 2010-014796 filed Jan. 26, 2010, the entire contents of which are hereby incorporated herein by reference.

BACKGROUND OF THE INVENTION

1. Field of the Invention

The present invention generally relates to an image forming apparatus, and more particularly to a maintenance and recovery mechanism removing droplets and foreign matter remained and adhered to a droplet discharge section so that the discharge function of the droplet discharge apparatus is well maintained.

2. Description of the Related Art

As is well known, an image forming apparatuses such as a printer, a facsimile machine, a copier, and a multifunction peripheral having those functions includes a droplet discharge apparatus having a recording head including a droplet discharge head to discharge droplets such as ink.

In an apparatus discharging droplets such as ink, an image is formed by adhering or absorbing (impregnating) droplets discharged from a recording head onto or into a recording medium such a recording sheet while the recording medium is being fed.

In this case, the recording medium to be printed includes not only such a recording sheet but also any material to or into which a liquid can be adhered or absorbed, the material including fibers such as strings, leather, a metal, resin, glass, wood, ceramic and the like.

In such an image forming apparatus having the droplet discharge apparatus, ink retained on a nozzle surface of a droplet discharge head by surface tension of an ink meniscus is discharged (ejected) in a predetermined direction with a predetermined size by using a pressure caused by film boiling of ink or the like.

As a method of discharging droplets, there have been proposed a piezoelectric conversion method using a piezoelectric device, an electrostatic suction method using an electrostatic attractive force (see, for example, Japanese Patent Application Publication No. 2009-45870, "Patent Document 1"), a thermal conversion method such as bubble-jet (registered trademark) type (see, for example, Japanese Patent Application Publication No. 2007-290243, "Patent Document 2") and the like.

On the other hand, at the droplet discharge head, a maintaining and recovering operation is generally performed. By performing the maintaining and recovering operation, it becomes possible to prevent ink remained and adhered to a nozzle surface of the droplet discharge head from being thickened and avoid that ink is discharged in the direction other than a predetermined direction, that ink has a size other than a predetermined size, and that the meniscus of ink is destroyed (deformed) due to the ingress of foreign matter into the nozzle.

As an example of a structure performing the maintaining and recovering operation, a cap is used for sealing a nozzle surface of a liquid discharge head and a negative pressure is applied to the inside of the cap to suction ink from the nozzle (see for example, Japanese Patent No. 4149821, "Patent Document 3").

Further, as an example of a structure suctioning ink from the inside of the cap and cleaning the discharge head, a carriage is slightly moved during the suction operation so as to form a gap at a part of the cap to generate air flow within the cap to flow ink absorbed in an ink absorbing body from the nozzle surface to the absorbing section. Then, the nozzle surface is wiped by a wiper made of an elastomer material. By doing this, the nozzle surface is cleaned and the meniscus of ink in the nozzle is recovered (see, for example, Japanese Patent Application Publication No. 06-126947, "Patent Document 4").

However, in a case where ink accumulated in the nozzle or on the nozzle surface is suctioned in a manner as disclosed in Patent Document 3, when the cap is separated from the nozzle surface while the negative pressure is still large, a sudden pressure change may occur, and due to the sudden change of the pressure, the meniscus in the nozzle may be destroyed (deformed).

On the other hand, when the structure disclosed in Patent Document 4 is used, it may become easier to flow ink retained in the ink absorbing body. However, if the gap is not properly generated, a large amount of ink may be retained on the nozzle surface and the large amount of ink may be adhered to the wiper when the wiper wipes the ink. Because of this feature, when the ink adhered to the wiper is left for a long period, the ink may be thickened or may be fixed to the wiper. As result, the thickened or fixed ink may block the wiping capability of wiping the nozzle surface. In this case, the contacting area between the wiper surface and the nozzle surface may become smaller, thereby reducing the efficiency of removing ink from the nozzle surface. This phenomenon may affect the meniscus of ink and block normal discharging operation, which may degrade the quality of print data, increase maintenance cost of the wiper, and affect the maintenance and recovery mechanism of the apparatus.

Further, the gap to be formed at a part of the cap is formed while the cap is inclined against the nozzle surface due to the slight movement of the carriage. In this case, in order to ensure the sealing and adhesion performance between the cap and the nozzle surface, a flexible material such as elastomer is generally used. Because of this feature, for example, after the slight movement is repeated for a long period, the shape of the flexible material may not be easily recovered (i.e., the shape of the flexible material may be deformed), thereby making it difficult to maintain the sealing and adhesion performance.

On the other hand, ink retained on the surface of the nozzle surface is once absorbed (suctioned) into the ink absorbing body provided in the cap. After a certain time interval, the absorbed ink is further suctioned. Therefore, due to the time interval, ink may be thickened or fixed before being suctioned. In this case, the suctioning function may not be appropriately maintained.

Further, it may be required to fill the cap with ink in advance in order to remove ink retained on the nozzle surface. However, to fill the cap with ink, the suction operations is always required to be performed to withdraw ink from the inside of the nozzles. Because of this feature, ink filled in the cap may be unnecessarily wasted and ink consumption amount may be increased.

Next, with reference to FIGS. 1 through 4, a problem is described which may be occurred when such a method as disclosed in Patent Document 4 is used where a wiper wipes ink.

Conventionally, to perform the maintaining and recovering operation on the nozzles of the droplet discharge head, as schematically illustrated in FIG. 1, a cap B being in close contact with a nozzle surface A1 of a droplet discharge head A is used as a sealing member. Further, while the cap B is in close contact with the nozzle surface A1 of the droplet discharge head A, a negative pressure is applied to the inside of the cap B using a suction mechanism (not shown), so that droplets (i.e., ink L and foreign matter) are suctioned from nozzles A2.

After ink is suctioned from the nozzles A2, the cap B is separated from the nozzle surface A1 of the droplet discharge head A. As a result, as schematically illustrated in FIG. 2, a large amount of ink L' withdrawn from the inside of the nozzles due to the negative pressure applied to the inside the cap A remains on the nozzle surface A1 of the droplet discharge head A in dorm shapes or in a combined shape.

Then, as schematically illustrated in FIG. 3, the remaining ink is wiped off by using a wiper C made of a material such as an elastomer. In this case, however, as schematically illustrated in FIG. 4, when the wiped ink is left on the wiper C for a period of time, the ink remaining on the wiper C may be thickened or fixed to the wiper C, which may block the further wiping operation. As a result, once the ink is thickened or fixed to the wiper C, ink on the nozzle surface A1 of the droplet discharge head A may not be sufficiently removed with the wiper C.

As described above, when a method as described in Patent Document 4 is used, when ink is suctioned to recover the meniscus of ink in the nozzle and ink remained on the nozzle surface is moved at the same time, there may arise a problem in further wiping operation and a problem in further suction operation.

SUMMARY OF THE INVENTION

The present invention is made in light of the foregoing problems in the conventional droplet discharge apparatus. Further, the present invention may provide a droplet discharge apparatus improving the performance of recovering the meniscus in the nozzle and ensuring to remove ink (i.e., a liquid) remaining on the nozzle surface by ensuring the performance of the droplet suction operation from the nozzle by preventing the deformation of a member used for the suction operation.

According to an aspect of the preset invention, there is provided an image forming apparatus including a droplet discharge head and a maintenance and recovery mechanism. The maintenance and recovery mechanism includes a head sealing member facing the droplet discharge head and moving to a position where a surface of the droplet discharge head is sealed off from outside of the head sealing member; and a suction force generator generating a suction force inside the head sealing member to suction ink from nozzles of the droplets discharge head. Further, the head sealing member moves the droplets remaining on a nozzle surface of the droplet discharge head along the nozzle surface and suctioning the droplets.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, embodiments of the present invention are described in the following examples with reference to the accompanying drawings.

Figure 1:
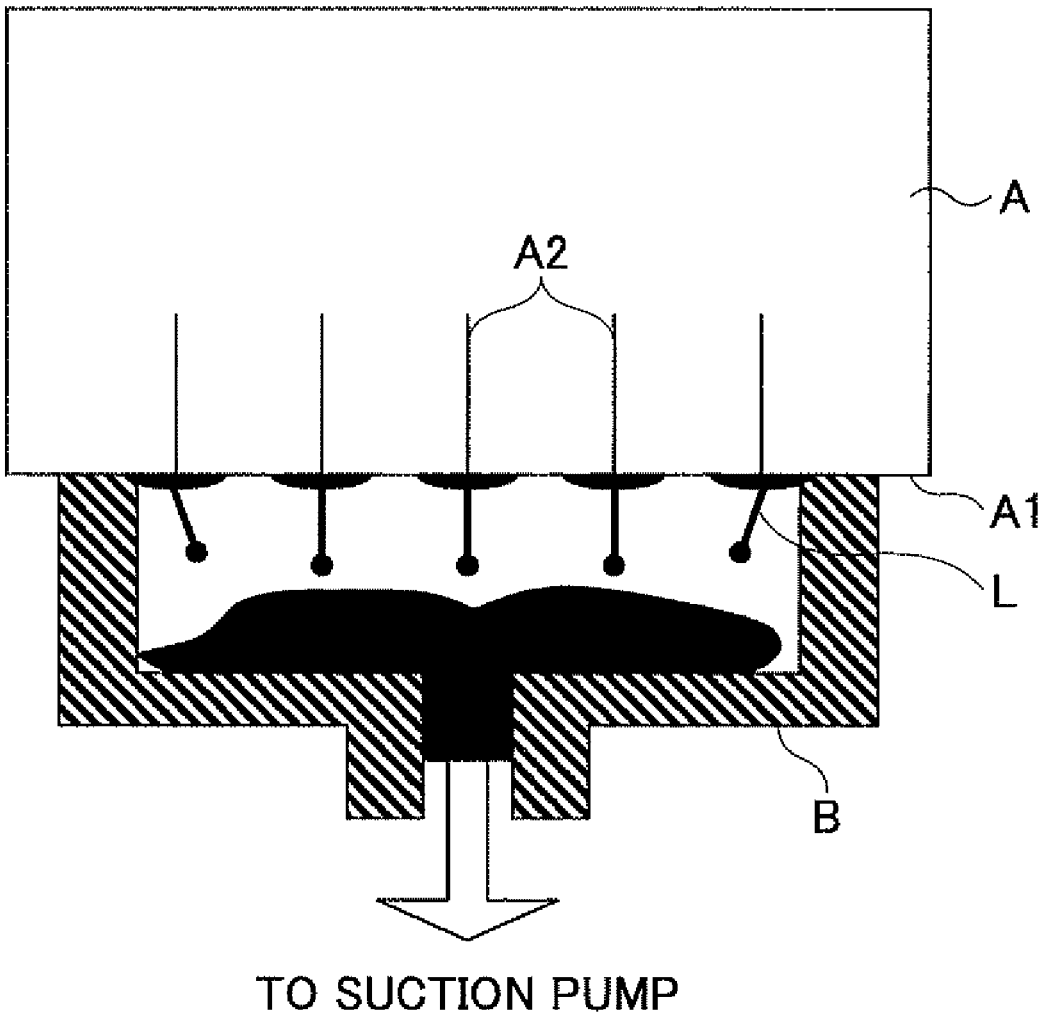
FIG.1 RELATED ART
FIG. 1 is a schematic drawing illustrating an exemplary configuration of a conventional maintenance and recovery mechanism.
Figure 2:
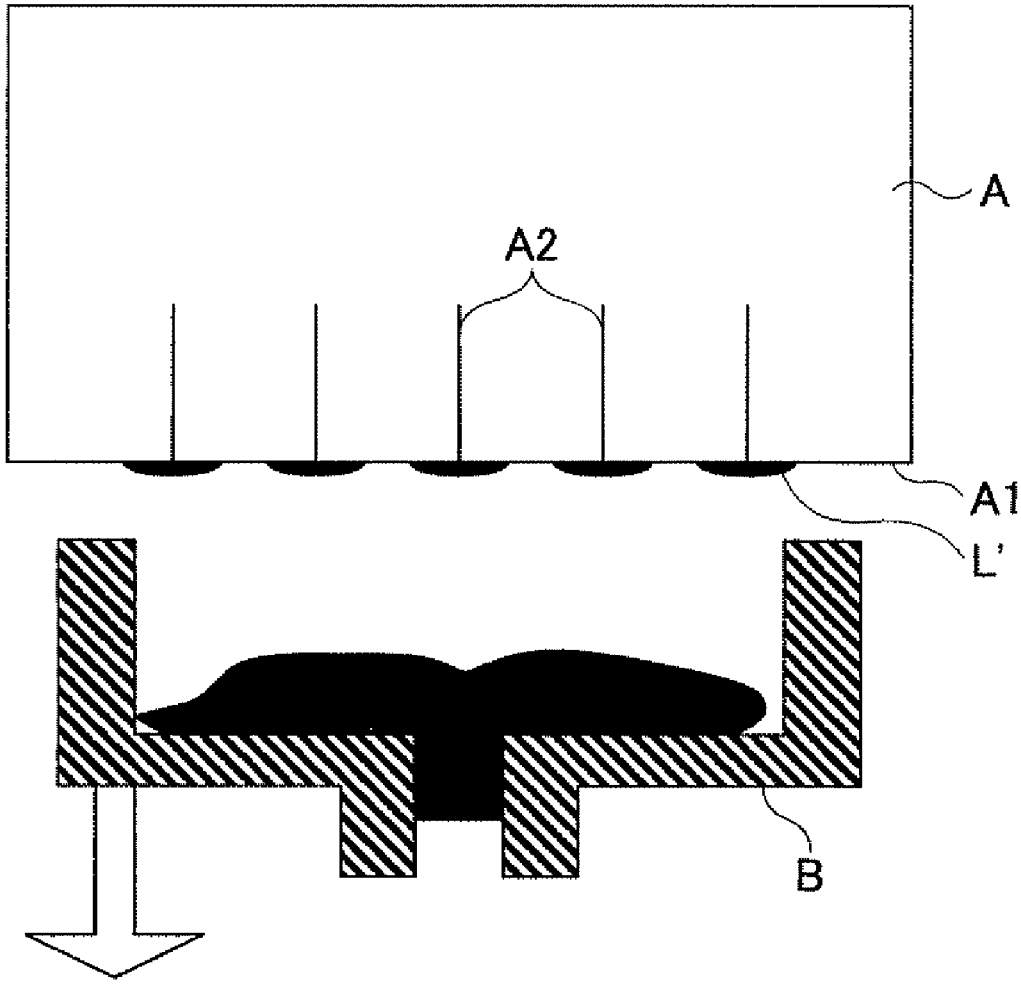
FIG.2 RELATED ART
FIG. 2 is a schematic drawing illustrating a status during an operation performed by the configuration illustrate in FIG. 1.
Figure 3:
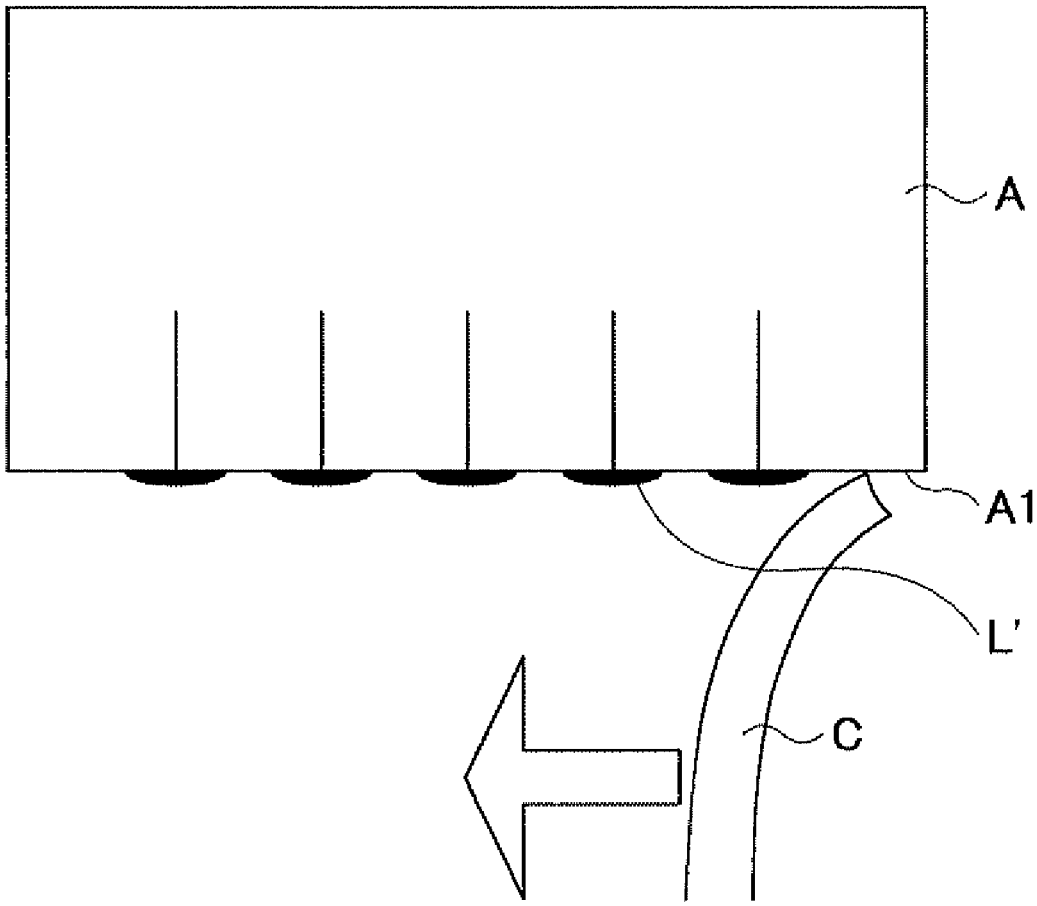
FIG.3 RELATED ART
FIG. 3 is a schematic drawing illustrating a configuration for a wiping operation to be performed after the status of FIG. 2.
Figure 4:
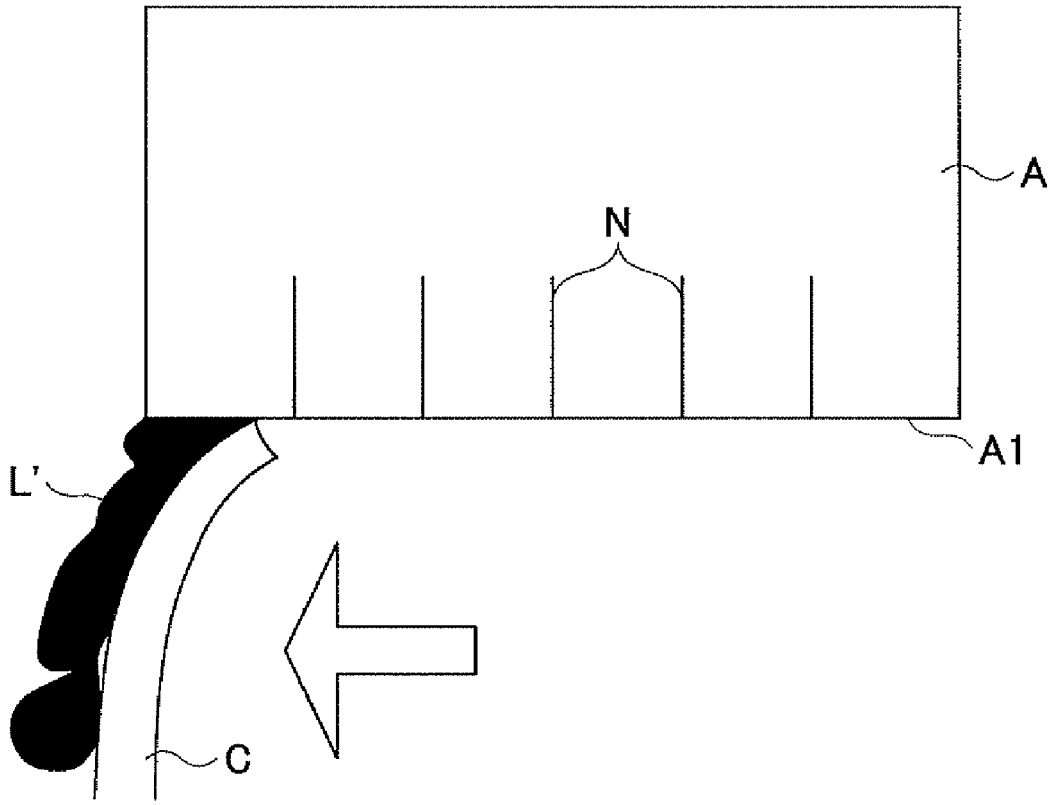
FIG.4 RELATED ART
FIG. 4 is a schematic drawing illustrating a problem that may occur after the wiping operation using the configuration illustrated in FIG. 3.
Figure 5:
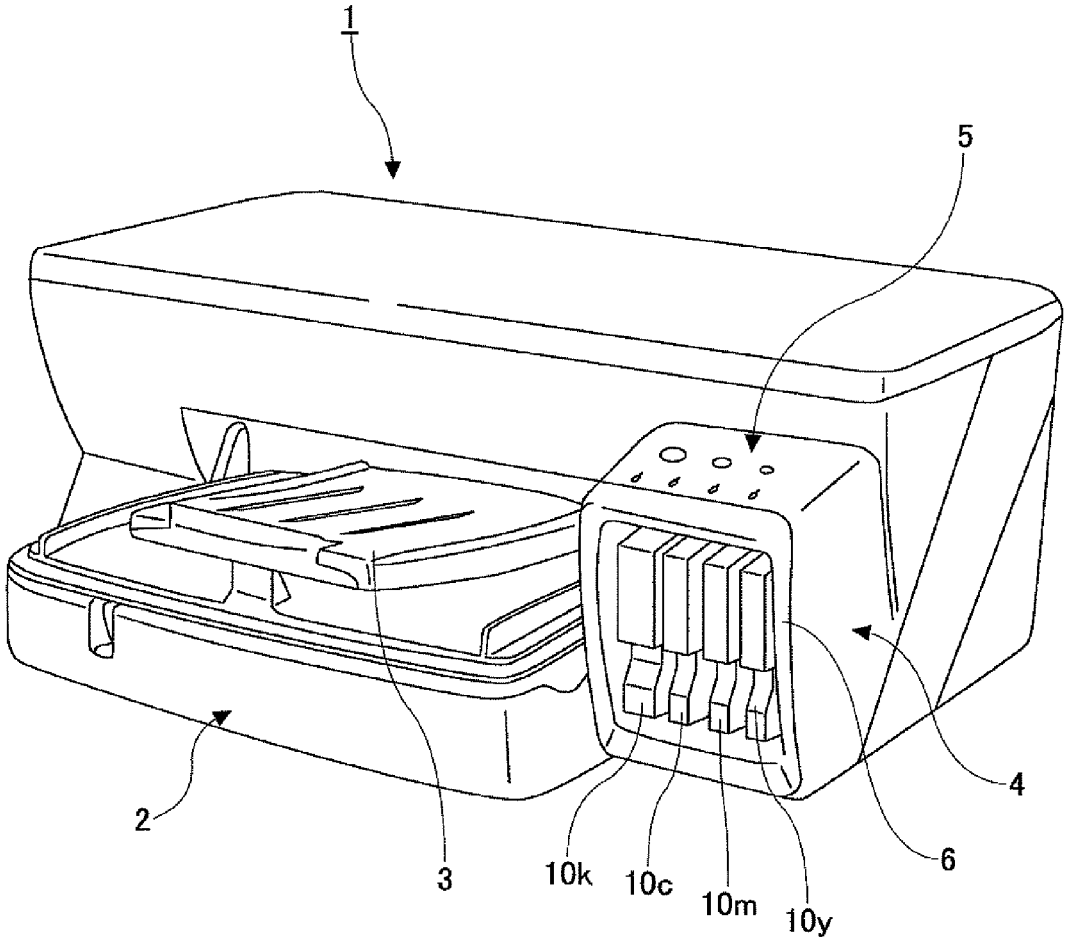
FIG. 5 is an external view of an image forming apparatus having a droplet discharge apparatus according to an embodiment of the present invention.

FIG. 5 schematically illustrates an external appearance of an image forming apparatus having a droplet discharge apparatus according to an embodiment of the present invention. As illustrated in FIG. 5, the image forming apparatus includes an apparatus main body 1, a sheet feeding tray 2 that is attached to the apparatus main body 1 and that is provided for loading sheets to the apparatus main body 1, and a sheet discharge tray 3 that is detachably attached to the apparatus main body 1 and that stacks sheets on which an image is to be recorded (formed).

Further, the image forming apparatus includes a cartridge loading section 4 provided on one end side (opposite to the end side where the sheet feeding tray 2 is provided) of the front face of the apparatus main body 1 in a manner such that a part of the cartridge loading section 4 is protruded beyond the front face of the apparatus main body 1, so that an ink cartridge disposed at a position lower than the upper surface of the cartridge loading section 4 can be loaded into the cartridge loading section 4.

Further, the image forming apparatus includes an operation/display section 5 that is provided on the upper surface of the cartridge loading section 4 and that includes an operation button and a display unit.

The cartridge loading section 4 is provided so that plural ink cartridges 10*k*, 10*c*, 10*m*, and 10*y* containing respective colors of ink: black (k), cyan (c), magenta (m), and yellow (y) can be loaded (fed) into the cartridge loading section 4 from the front end side to the rear end side of the apparatus main body 1. Further, the cartridge loading section 4 includes a front cover (cartridge cover) 6 that is provided to be opened and closed on the front surface side of the cartridge loading section 4 and that is open when the cartridge is to be loaded into the cartridge loading section 4. Herein, when it is not necessary to distinguish those ink cartridges, the term "ink cartridge(s) 10" may be collectively used in the following description.

Figure 6:
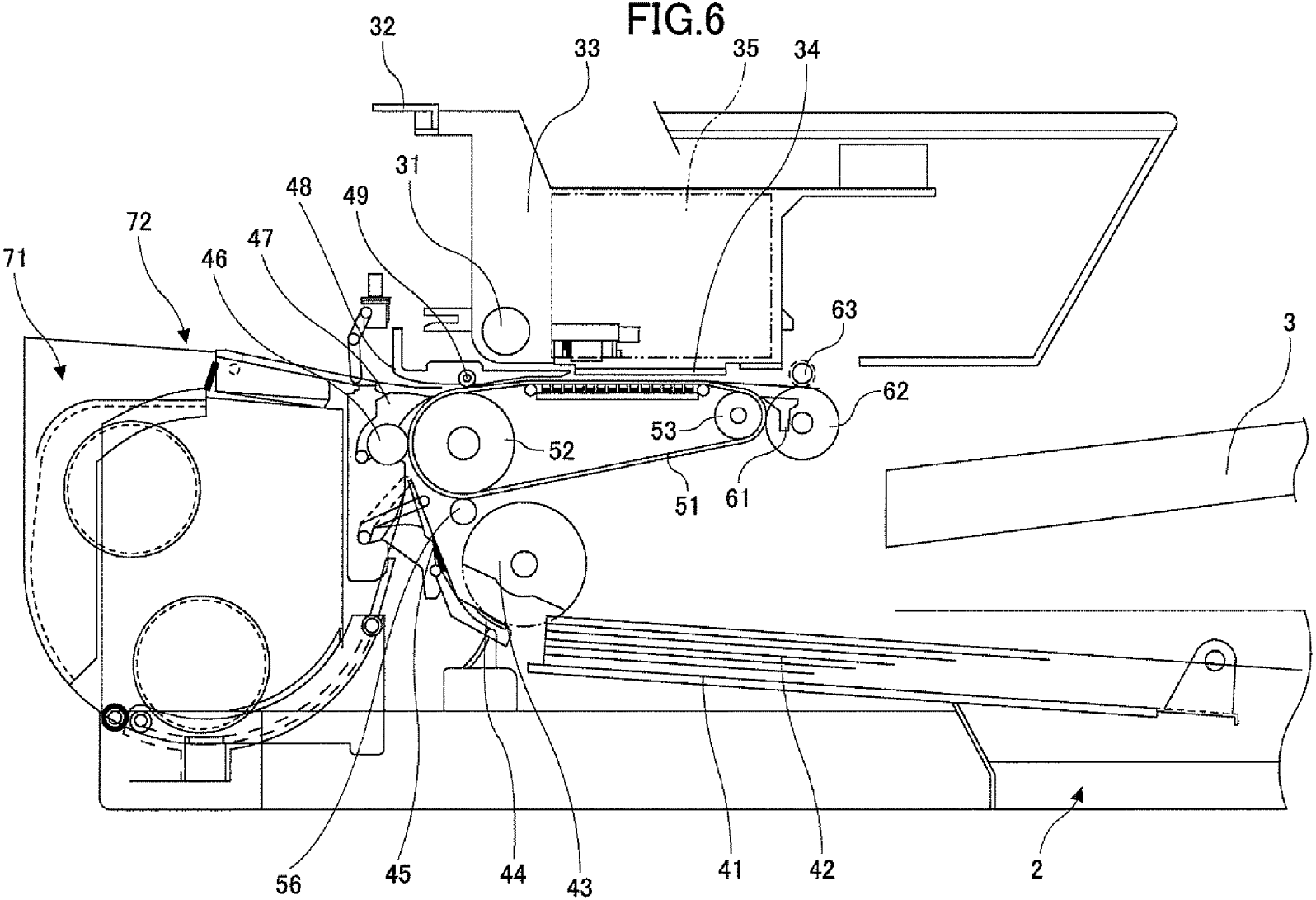
FIG. 6 is a schematic cross-sectional view illustrating an internal configuration of the image forming apparatus of FIG. 5.

Next, a mechanical part of the droplet discharge apparatus is described with reference to FIGS. 6 and 7. FIG. 6 is a schematic cross-sectional side view of the mechanical part of the droplet discharge apparatus, and FIG. 7 is a schematic plan view of the mechanical part of the droplet discharge apparatus.

Figure 7:
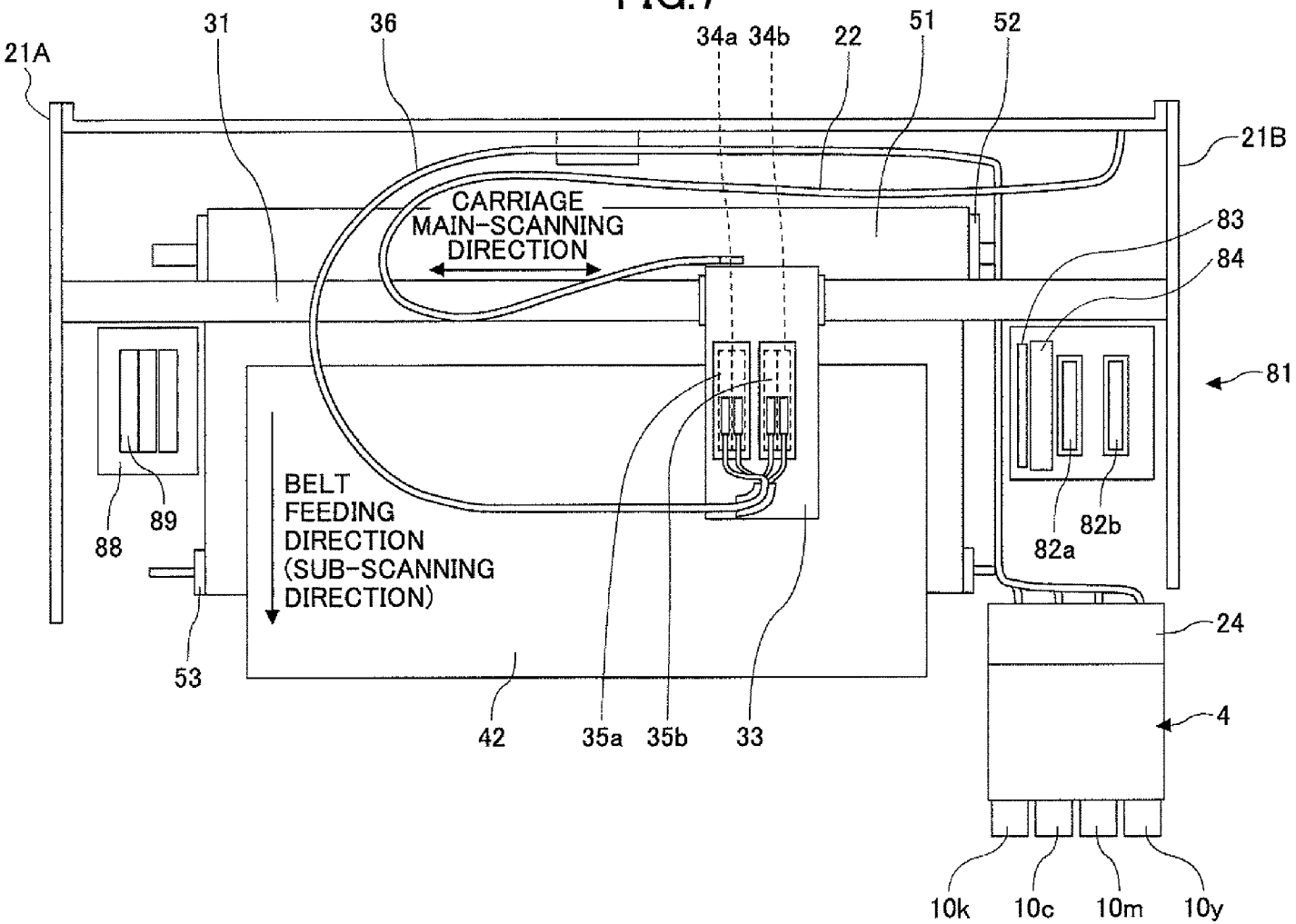
FIG. 7 is a schematic plan view illustrating the internal configuration of FIG. 6.

As illustrated in FIG. 7, a carriage 33 is slidably supported in the main-scanning direction by a guide rod 31 and a stay 30 (see FIG. 6), the guide rod 31 being bridged between a left side plate 21A and a right side plate 21B. By having this configuration, the carriage 33 moves (scans) in the arrow direction (i.e., the carriage main-scanning direction) in FIG. 7 upon being driven by a main-scanning motor (not shown) via a timing belt (not shown).

The carriage 33 includes droplet discharge heads 34*a* and 34*b* for discharging ink droplets of four colors: yellow (y), cyan (c), magenta (m), and black (k). Herein, when it is not necessary to distinguish those droplet discharge heads, the term "droplet discharge head(s) 34" may be collectively used in the following description.

The droplet discharge heads 34*a* and 34*b* includes nozzle arrays each having plural nozzles, the nozzle arrays being arranged in the sub-scanning direction perpendicular to the main-scanning direction. Further, the droplet discharge heads 34*a* and 34*b* are disposed in a manner such that the ink discharge direction is downward (i.e., ink is discharged in the downward direction).

In the example of FIG. 7, each of the droplet discharge heads 34*a* and 34*b* has two nozzle arrays. For example, one nozzle array of the droplet discharge head 34*a* may discharge black (k) ink droplets, and the other nozzle array of the droplet discharge head 34*a* may discharge cyan (c) ink droplets. On the other hand, one nozzle array of the droplet discharge head 34*b* may discharge magenta (m) ink droplets, and the other nozzle array of the droplet discharge head 34*b* may discharge yellow (y) ink droplets. However, for example, the same color ink may be discharged from both of the nozzle arrays of the droplet discharge head 34.

For example, an inkjet head of the droplet discharge head 34 may include pressure generation means that generates a pressure to be used for discharging droplets. The pressure generation means includes a piezoelectric actuator (e.g., a piezoelectric element), a thermal actuator using a phase change caused by film boiling of liquid using an electric-thermal conversion device (e.g., a heat element), a shape memory alloy actuator using metal phase change caused by temperature change, an electrostatic actuator using electrostatic force and the like.

In the configuration of FIGS. 6 and 7, head tanks 35*a* and 35*b* are provided (mounted) in the carriage 33. The head tanks 35*a* and 35*b* is served as a liquid accommodating container that stores ink of various colors to be supplied to the nozzle arrays of the droplet discharge head 34. Herein, when it is not necessary to distinguish those head tanks, the term "head tank(s) 35" may be collectively used in the following description.

The head tank 35 is replenished with ink of various color supplied from the respective ink cartridges 10 loaded in the cartridge loading section 4 via respective ink supply tubes 36 as described above. Further, the cartridge loading section 4 includes a supply pump unit 24 that feeds ink into the ink cartridge 10. Further, as illustrated in FIG. 7, there is provided a path 22 to be used for wasting ink collected on the droplet discharge head 34 side of a maintenance and recovery mechanism 81 which is described in detail below.

On the other hand, as illustrated in FIG. 6, as a sheet feeding section for feeding a sheet(s) 42 stacked on a sheet stacking section (platen) 41 of the sheet feeding tray 2, there are provided a half moon roller (sheet feeding roller) 43 and a separation pad 44. The half moon roller (sheet feeding roller) 43 separates a sheet 42 one by one from the sheets 42 stacked on the sheet stacking section (platen) 41 and feeds the separated sheet 42. The separation pad 44 faces the half moon roller (sheet feeding roller) 43 and is made of a material having high friction coefficient. The separation pad 44 is biased towards the half moon roller (sheet feeding roller) 43 side.

Further, in order to further feed the fed sheet 42 to the position under the droplet discharge head 34, there are provided a guide member 45 guiding the sheet 42, a counter roller 46, a feed guide member 47 serving as a separation nail as well, and a pressing member 48 having a top pressing roller 49. Further, there is provided a feeding belt 51 that serves as feeding means that electrostatically adsorbs the fed sheet 42 at the position facing the droplet discharge head 34 to further feed the sheet 42.

The feeding belt 51 is an endless belt bridged between a feed roller 52 and a tension roller 53 so that feeding belt 51 rotates in the belt feeding direction (i.e., sub-scanning direction). Further, there is provided a charge roller 56 that serves as charging means that charges the surface of the feeding belt 51. The charge roller 56 is in contact with a surface layer of the feeding belt 51 and is disposed in a manner such that the charge roller 56 rotates according to the rotation of the feeding belt 51. The feeding belt 51 rotates (moves) in the belt feeding direction in FIG. 6 in accordance with the rotation of the feed roller 52 which is rotatably driven by a sub-scanning motor (not shown) by timing.

Further, as a sheet discharge section for discharging the sheet 42 recorded by the droplet discharge head 34, there are provided a separation nail 47, one or more sheet discharge rollers (not shown), and the sheet discharge tray 3 disposed under one of the discharge rollers. The separation nail 47 separates the sheet 42 from the feeding belt 51.

Further, a double side unit 71 is detachably attached to the rear part of the apparatus main body 1. The double side unit 71 receives the sheet 42 returned by performing the reverse rotation of the feeding belt 51, reverses the received sheet 42, and feeds (returns) the reversed sheet 42 in between the counter roller 46 and the feeding belt 51. Further, a manual tray 72 is provided on the upper surface of the double side unit 71.

Further, as illustrated in FIG. 7, in a non-printing region on one side of the scanning direction of the carriage 33, there is provided the maintenance and recovery mechanism 81 that is a main part of the droplet discharge apparatus according to an embodiment of the present invention as described below.

The maintenance and recovery mechanism 81 is used for maintaining the nozzle surface of the droplet discharge head 34 so as to stabilize the performance of ink discharge operation of the droplet discharge head 34. In the following, the droplet discharge head 34 may be simplified as "droplet head (34)".

As illustrated in FIG. 7, the maintenance and recovery mechanism 81 includes cap members 82*a* and 82*b*, a blade member 83, a preliminary discharge receiver 84. The cap members 82*a* and 82*b* are in close contact with and seals the nozzle surface corresponding to a head surface of the droplet discharge head 34. The blade member 83 is used to wipe the nozzle surface. The preliminary discharge receiver 84 receives (stores) droplets discharged in a preliminary discharge operation. Herein, the preliminary discharge (operation) refers to a discharge (operation) that discharges droplets that are not necessary for recording (printing) and that may have been thickened.

The cap members 82*a* and 82*b* are made of an elastic material and are moved their positions so as to surround and seal the outer circumference of the corresponding droplet discharge heads 34. In this case, the moving direction of the cap members 82*a* and 82*b* is the direction parallel to the ink discharge direction.

Next, the features of the above-described configuration according to this embodiment of the present invention are described.

In this embodiment, besides the operation of suctioning ink from the inside of the nozzles, an operation of removing ink remaining on a nozzle surface 34*a*1 (see FIG. 8) of the droplet discharge head 34 is separately performed by moving ink so that ink moves along the nozzle surface 34*a*1.

Figure 8:
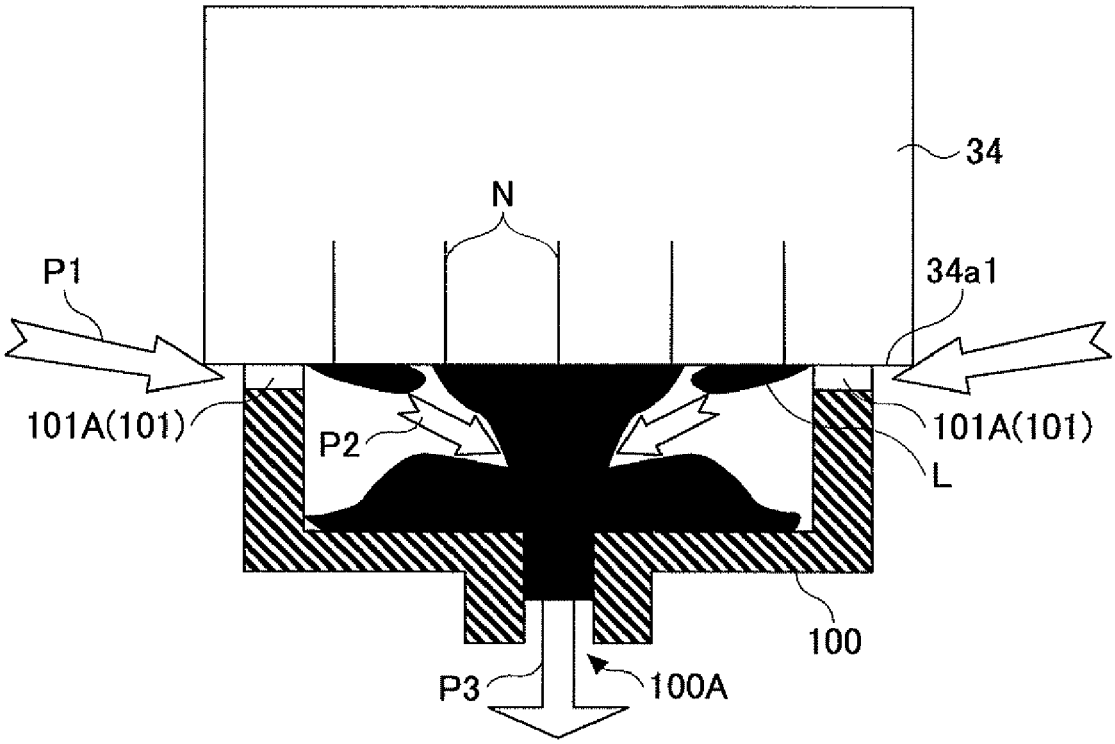
FIG. 8 is a schematic view illustrating a configuration of the maintenance and recovery mechanism used in the droplet discharge apparatus of the image forming apparatus of FIG. 5.

As schematically illustrated in FIG. 8, instead of using the cap member, there is provided a pad 100 that is made of an elastic material similar to that of the cap member and that is in close contact with and sealing the nozzle surface 34*a*1. Namely, the pad 100 is movably disposed in the direction parallel to the ink discharge direction so that the pad 100 can be in contact with and be separated from the nozzle surface 34*a*1.

The pad 100 made of an elastic material is in close contact with the nozzle surface 34*a*1 in a manner such that the pad 100 surrounds the outer circumference of a region where nozzles (nozzle arrays) N are arranged on the nozzle surface 34*a*1. Further, as illustrated in FIG. 8, in the center of the pad 100, a suction port 100A is formed so that the inside of the pad 100 is in communication with a vacuum pump (not shown).

Further, at a rim portion of the pad 100 where the pad 100 is to be in close contact with the nozzle surface 34*a*1, there are formed atmosphere communication sections 101. The atmosphere communication sections 101 include respective slits 101A.

Figure 9:
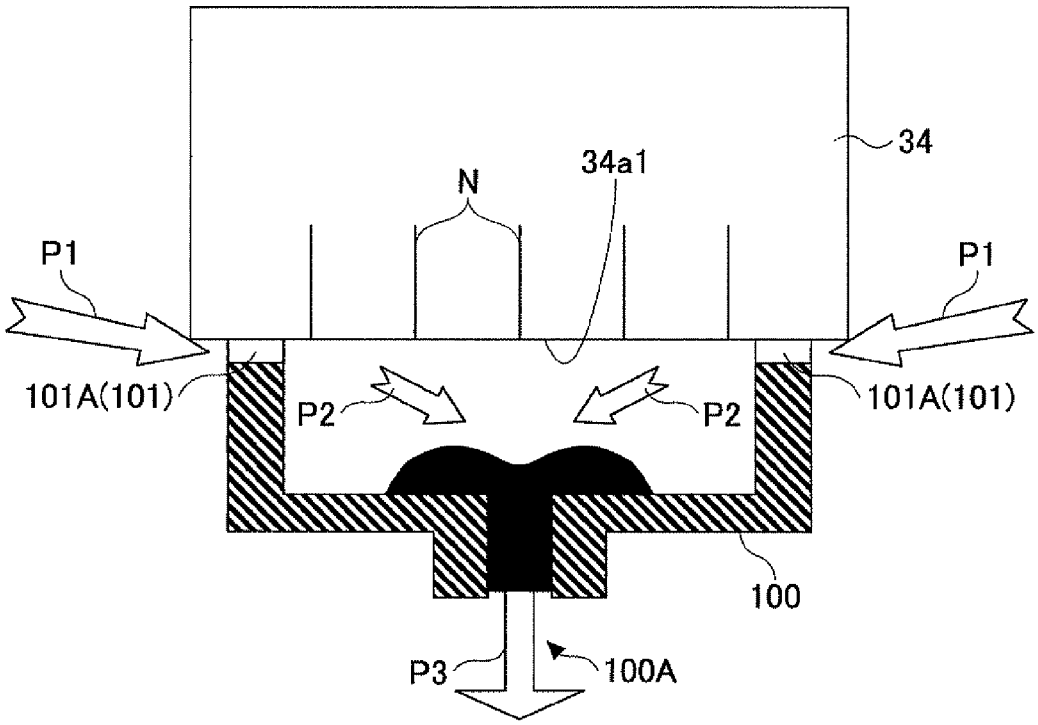
FIG. 9 is a schematic drawing illustrating an operation of the maintenance and recovery mechanism in FIG. 8.

In the above configuration, when the pad 100 is in close contact with the nozzle surface 34*a*1 of the droplet discharge head 34 to seal the inside of the droplet discharge head 34 and then a pressure in the pad 100 is reduced, as schematically illustrated in FIG. 9, external air is introduced through the slits 101A of the atmosphere communication sections 101. In this case, air is introduced in the direction along the nozzle surface 34*a*1.

The air introduced in the pad 100 changes the processing directions into the directions towards the suction port 100A because the air is suctioned towards the suction port 100A. In FIG. 9, the arrows P1 and P2 denote the air flowing directions in the pad 100, and the arrow P3 denotes the suction direction induced by the vacuum pump (not shown).

By due to the air flows formed in using the pad 100, ink remaining on the nozzle surface 34*a*1 (the remaining ink is represented by a symbol L for explanatory purposes) is more likely to be moved along the nozzle surface 34*a*1. Further, the ink L is further moved (suctioned) towards the suction port 100A under the influence of a negative pressure applied through the suction port 100A. In order to promote the movement of ink on the nozzle surface 34*a*1 to reduce ink suction time, it may be preferable to reduce the wetting angle of ink on the nozzle surface 34*a*1 by performing water repellent finishing on the nozzle surface 34*a*1.

According to this embodiment of the present invention, by simply moving the pad 100 in the ink discharge direction and maintaining the state where the pad 100 is in close contact with the nozzle surface 34*a*1 under a negative pressure condition, it may become possible to move the ink on the nozzle surface 34*a*1 towards the suction port 100A. By doing this, it may become possible to remove ink from the nozzle surface 34*a*1 without performing (repeating) the slight movement on the droplet discharge head 34 side to form the gap between the cap member and the nozzle surface. Because of this feature, according to this embodiment of the present invention, the sealing member (pad 100) may not be deformed unlike the case where, for example, the slight movement is required to be performed. Therefore, it may become possible to maintain the capability of removing ink remaining on the nozzle surface for a longer time period.

Figure 10:
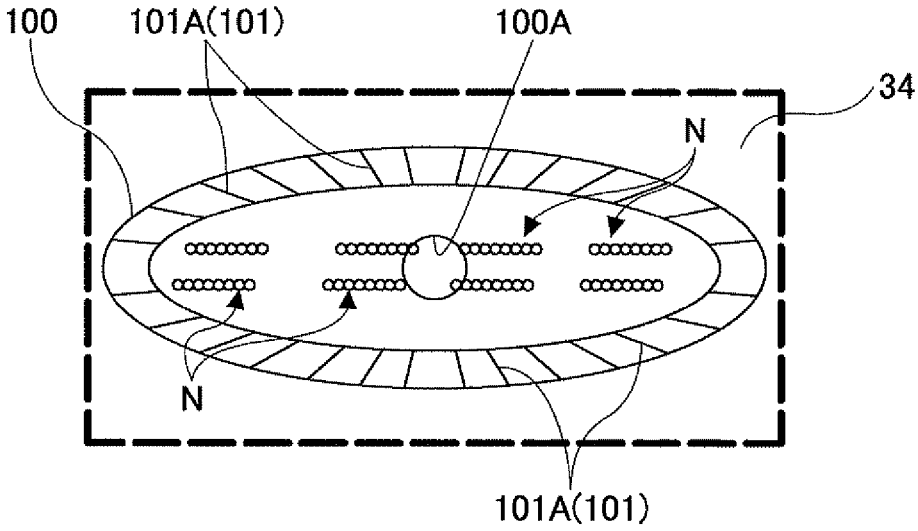
FIG. 10 is a plan view illustrating a main part of the maintenance and recovery mechanism in FIG. 9.
Figure 11:
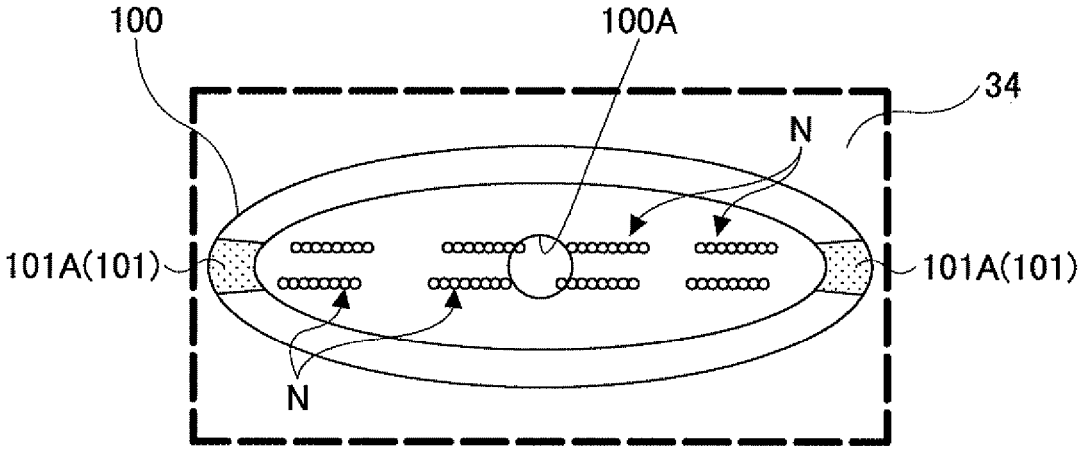
FIG. 11 is a plan view illustrating a partially modified main part of the maintenance and recovery mechanism in FIG. 10.

As illustrated in FIG. 10, plural slits 101A may be formed in a manner such that the slits 101A are radially formed on the rim portion of the pad 100. Otherwise, as illustrated in FIG. 11, two slits 101A may be formed in the extension of the direction parallel to the nozzle array arranging direction (i.e., the sub-scanning direction), so that the slits 101A are disposed to the opposite sides with respect to the center of the nozzle arrays (i.e., the slits 101A are disposed so as to face each other across the center of the nozzle arrays). However, alternatively, the slits 101A may be formed in any other appropriate manner. In any case, it is preferable that air flow caused by the negative pressure in the pad 100 be uniformly applied to each of the directions of the nozzle arrays N.

Next, another embodiment of the present invention is described with reference to FIGS. 12 through 15.

In this embodiment as illustrated in FIGS. 12 through 15, the maintenance and recovery mechanism includes both a configuration suctioning ink from the nozzle surface 34*a*1 of the droplet discharge head 34 and a configuration suctioning ink by moving the ink along the nozzle surface 34*a*1 of the droplet discharge head 34.

Figure 12:
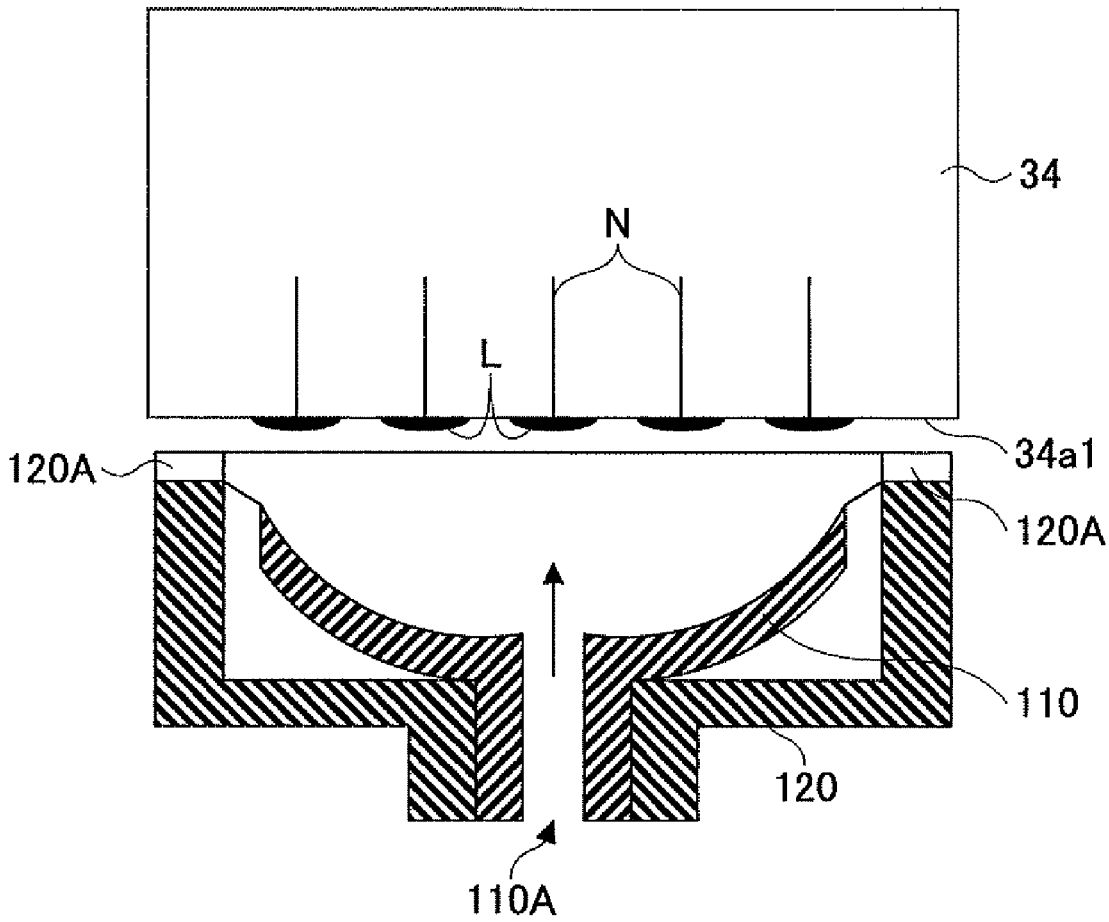
FIG. 12 is a schematic view illustrating an exemplary configuration of the maintenance and recovery mechanism according another embodiment of the present invention.

In this embodiment, as schematically illustrated in FIG. 12, there are provided not only a cap member 110 but also a pad 120 that surrounds the outer circumference of the cap member 110, which form a double structure. Both of the cap member 110 and the pad 120 are in close contact with and sealing the nozzle surface 34*a*1 of the droplet discharge head 34 as head sealing members. The cap member 110 is used (in close contact) for suctioning ink from the inside of the nozzles.

Figure 13:
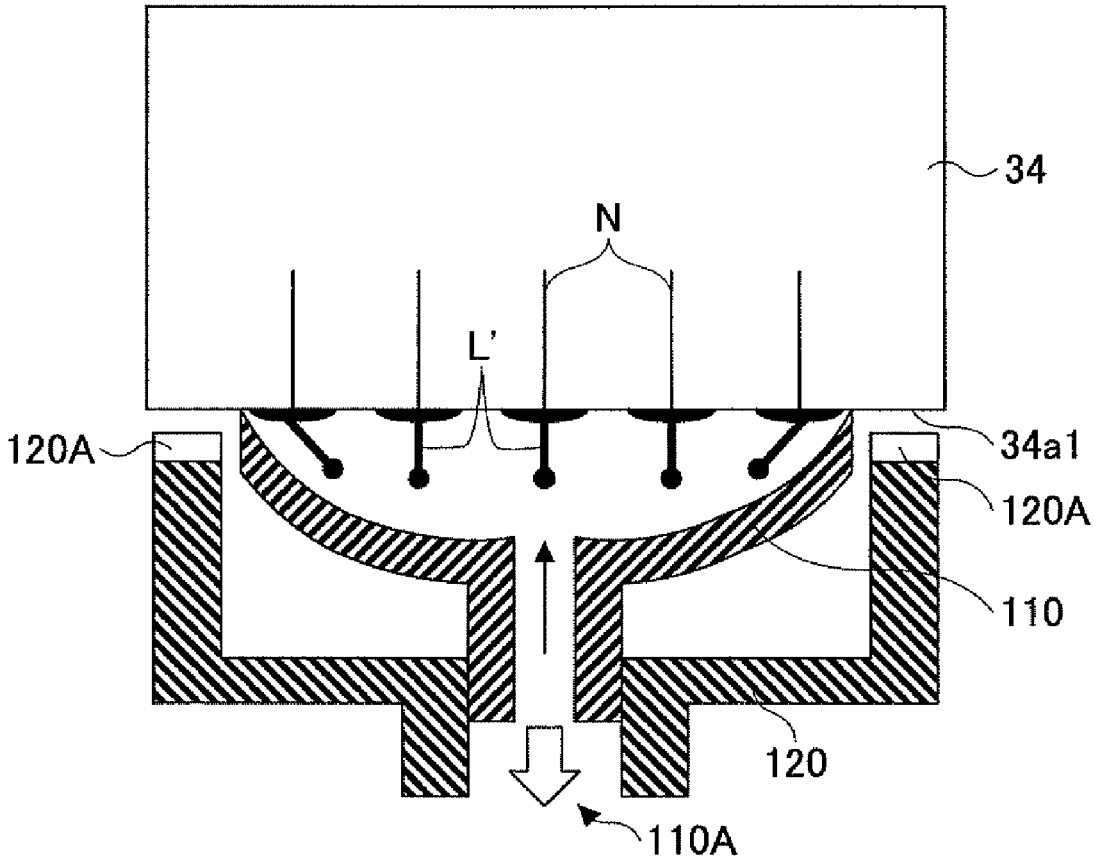
FIG. 13 is a schematic drawing illustrating a state of an operation of the maintenance and recovery mechanism in FIG. 12.

The cap member 110 is more generally used in this type of the maintenance and recovery mechanism 81. Namely, as illustrated in FIG. 13, the cap member 110 is used to suction ink and foreign matter (which are indicated by using a symbol L') from the inside of the nozzles while the cap member 110 is in close contact with the nozzle surface 34*a*1 and then the pressure in the cap member 110 is reduced (i.e., a negative pressure is applied to the inside of the cap member 110).

Figure 14:
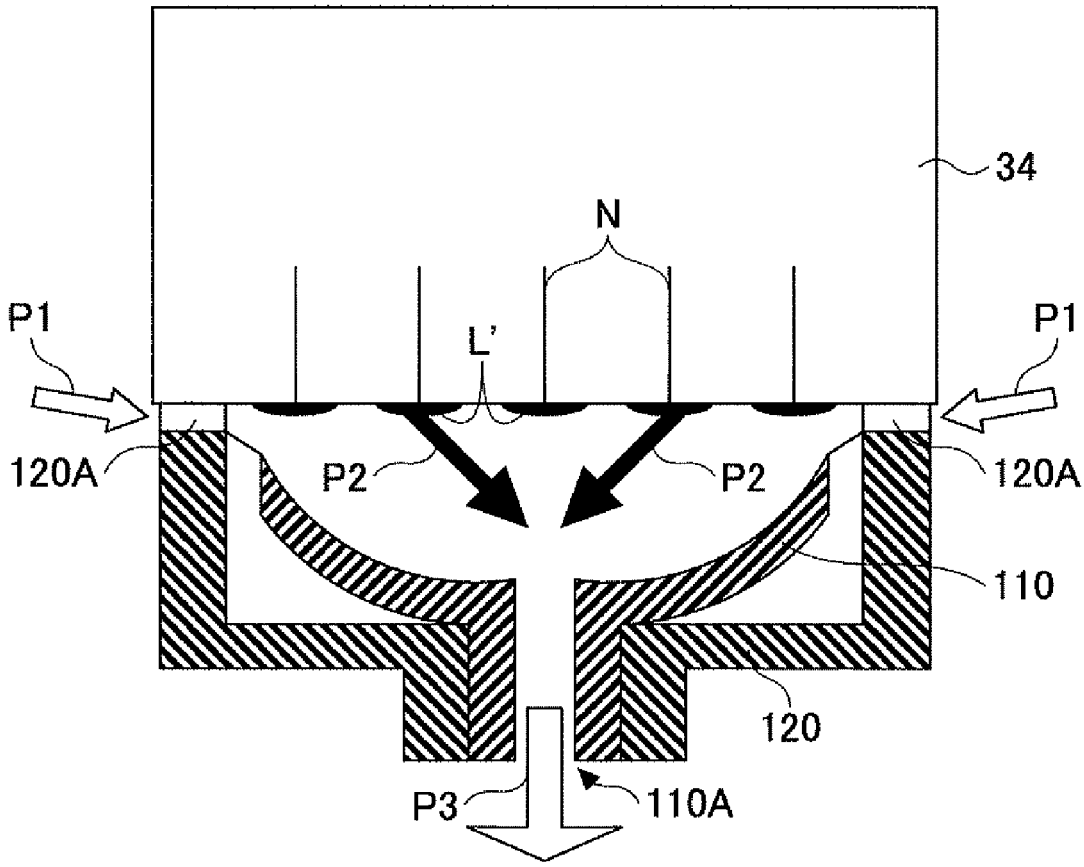
FIG. 14 is a schematic drawing illustrating another state of the operation of the maintenance and recovery mechanism in FIG. 12.

On the other hand, the pad 120 can be moved so as to be in contact with and separated from the nozzle surface 34*a*1 of the droplet discharge head 34 independently of the cap member 110. Therefore, as schematically illustrated in FIG. 14, the pad 120 may seal the nozzle surface 34*a*1 of the droplet discharge head 34 independently of the cap member 110 to form a negative pressure space inside the pad 120.

As illustrated in FIGS. 12 through 15, both of the cap member 110 and the pad 120 have a common suction port 110A.

Besides the suction operation of the cap member 110 that suctions ink and foreign matter from the inside of the nozzle arrays N, the pad 120 have also the function to suction and remove the ink remaining on the nozzle surface 34*a*1 (indicated by using a symbol L' in FIG. 14) from the nozzle surface 34*a*1.

To that end, similar to the case illustrated in FIG. 8, the slits 120A of the atmosphere communication sections are formed on the rim portion of the pad 120.

By having the configuration in this embodiment as described above, in order to perform a refresh operation of refreshing the nozzle arrays N, as schematically illustrated in FIG. 13, the cap member 110 is in close contact with the nozzle surface 34*a*1 of the droplet discharge head 34 and ink is suctioned from the nozzle arrays N.

On the other hand, in order to remove ink remaining on the nozzle surface 34*a*1, as schematically illustrated in FIG. 14, the pad 120 is in close contact with the nozzle surface 34*a*1 and then the suction operation is performed. By doing this, ink L' remaining on the nozzle surface 34*a*1 may move along the nozzle surface 34*a*1 in accordance with air flow introduced from the outside atmosphere and then be suctioned towards the suction port 110A in the negative pressure application direction applied from the suction port 110A.

In this embodiment, it may be set so that a suction force to be applied when the pad 120 is in close contact with the nozzle surface 34*a*1 is smaller than a suction force to be applied when the cap member 110 is in close contact with the nozzle surface 34*a*1. In other words, it is arranged that the suction force to be applied for suctioning ink remaining on the nozzle surface is smaller than the suction force to be applied for suctioning ink from the nozzles. By setting in this way, it may become possible to prevent ink in the nozzles from being suctioned, and accordingly the occurrence of the destruction of the meniscus of ink in the nozzles may be prevented.

Figure 15:
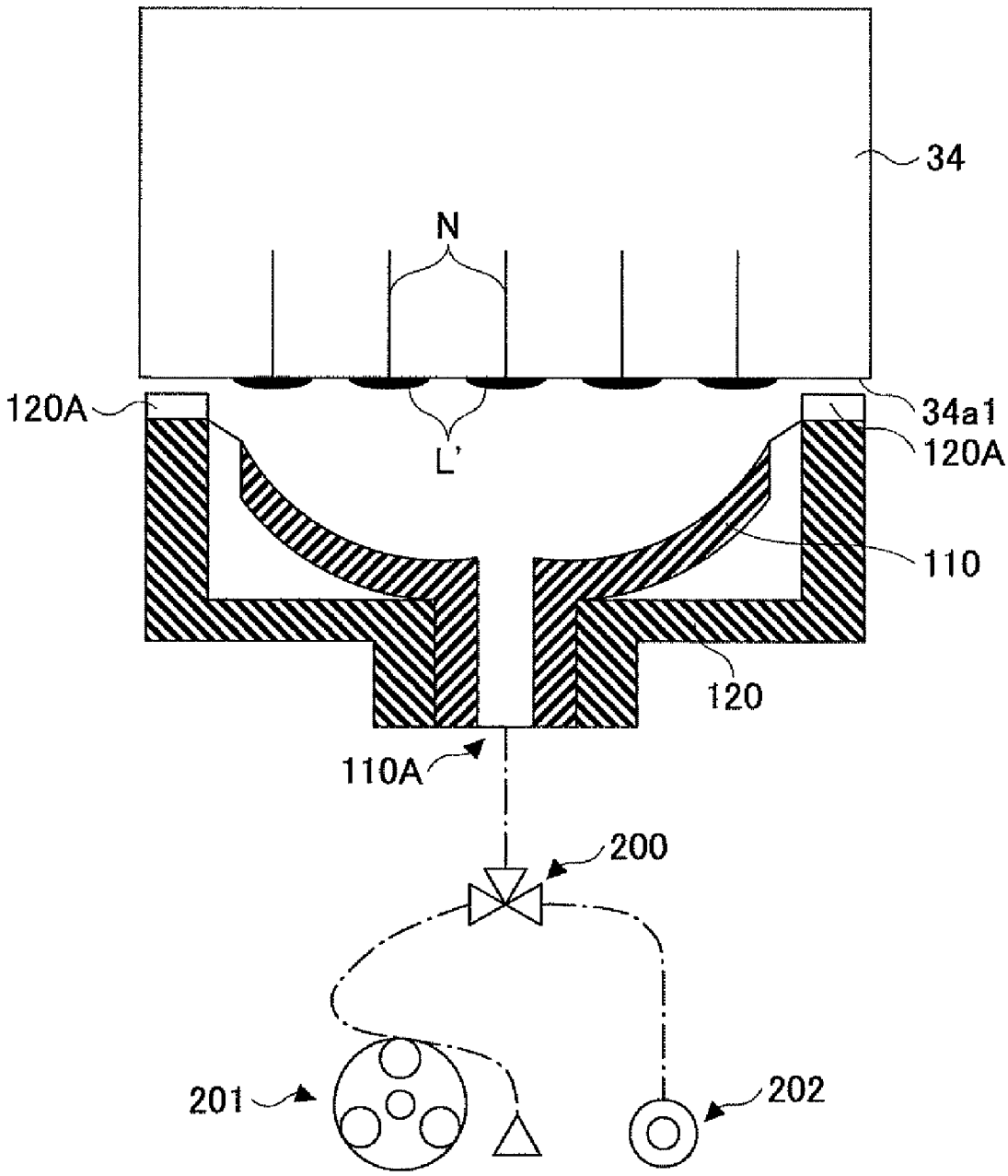
FIG. 15 is a schematic drawing illustrating a suction structure used in the maintenance and recovery mechanism in FIG. 12.

To make it possible to set (arrange) as described above, for example, a configuration as illustrated in FIG. 15 is used.

In the configuration of FIG. 15, the suction port 110A is in communication with a tubing pump 201 and a vacuum pump 202 via a three-way valve 200, the tubing pump 201 being operated in accordance with a rotation drive source (not shown).

The operation mode of the three-way valve 200 (i.e., direction setting) and the driving force of the pumps are controlled by a control section (not shown). The control section controls, for example, a timing when each of the cap member 110 and the pad 120 is to be in contact with the nozzle surface 34*a*1 of the droplet discharge head 34 and the relationship between the negative pressure value in the cap member 110 and the negative pressure value in the pad 120.

Namely, the cap member 110 is typically operated when an abnormality of the nozzle of the droplet discharge head 34 is detected. On the other hand, the pad 120 is operated when, for example, contamination of the nozzle surface is detected due to the leak of ink to the nozzle surface 34*a*1 after ink suction is performed by using the cap member 110. In this case, as described above, when the pad 120 is in contact with the nozzle surface 34*a*1 after ink suction is performed while the cap member 110 is in contact with the nozzle surface 34*a*1, the suction force is set to a value lower than that set when the ink suction is performed while the cap member 110 is in contact with the nozzle surface 34*a*1.

Next, still another embodiment of the present invention is described with reference to FIGS. 16 and 17.

In this embodiment, as a member that is in close contact with the nozzle surface 34*a*1 of the droplet discharge head 34 and that collects ink remaining on the nozzle surface 34*a*1, a porous member 130 being in close contact with the nozzle surface 34*a*1 is provided (used). Further, it is assumed that the timing when the porous member 130 is to be in close contact with the nozzle surface 34*a*1 is controlled independently of the timing when the cap member 110 is to be in close contact with the nozzle surface 34*a*1.

In the following, a configuration of this embodiment is described with reference to FIGS. 16 and 17. However, in those figures, the same reference numerals are used for the same elements in FIGS. 12 through 14.

Figure 16:
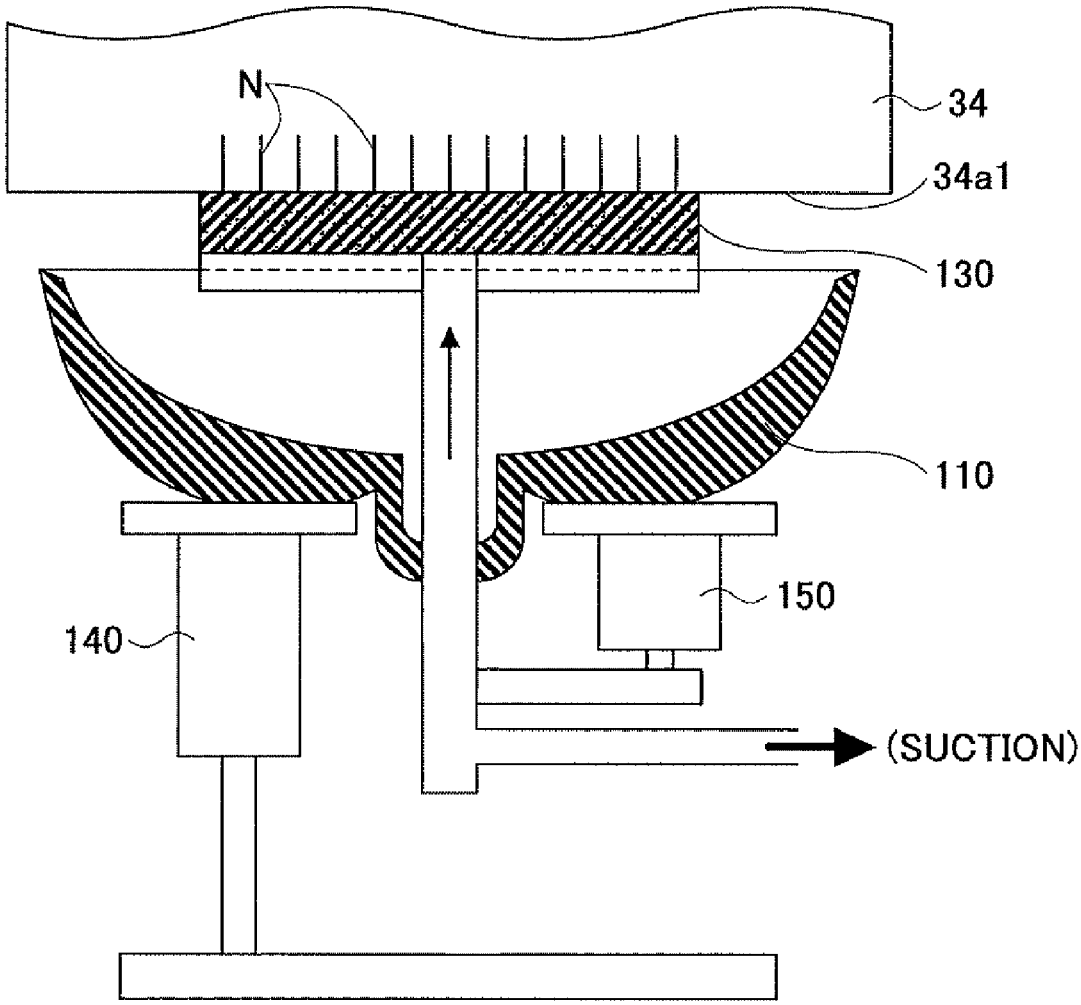
FIG. 16 is a schematic drawing illustrating a partially modified main part of the maintenance and recovery mechanism in FIG. 12.
Figure 17:
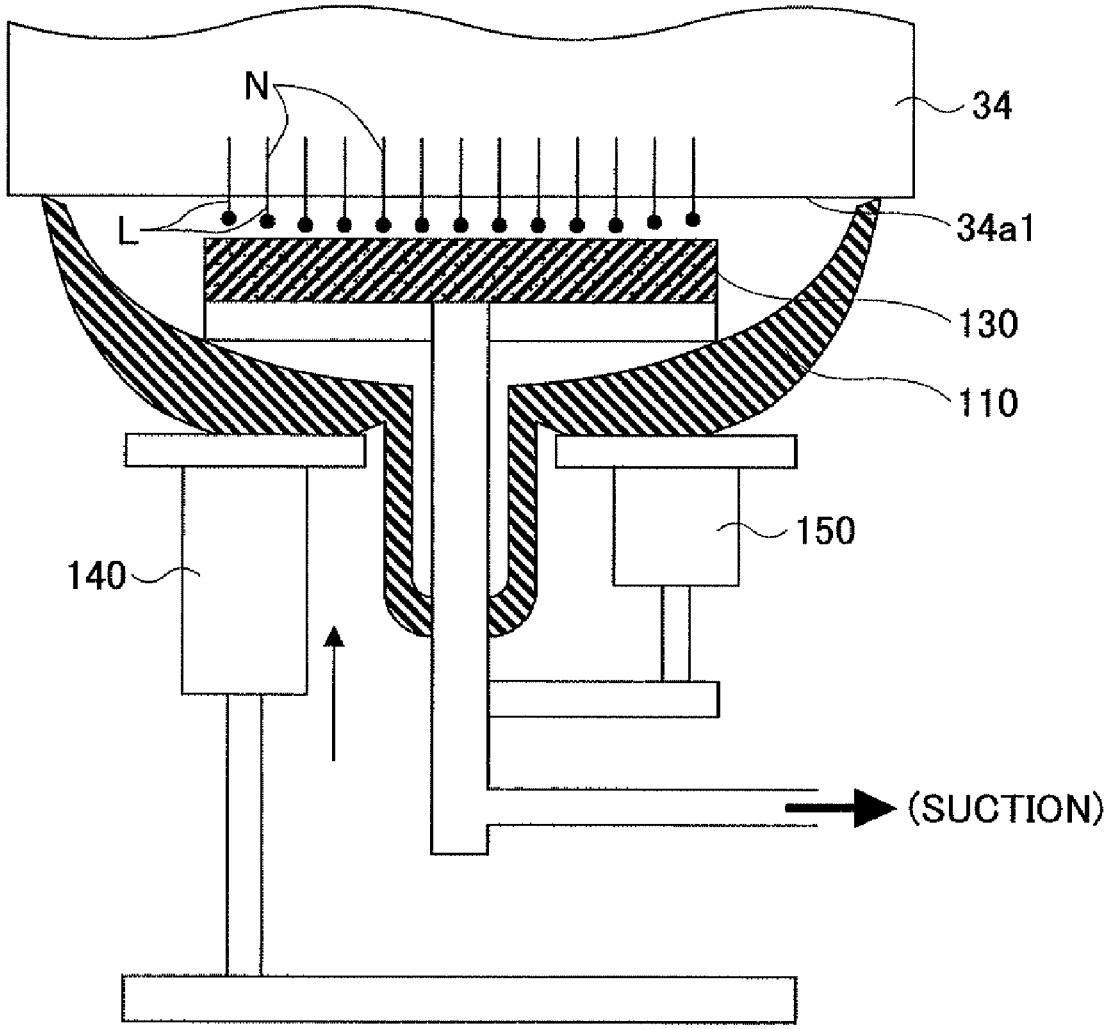
FIG. 17 is a schematic drawing illustrating a state of the operation of the partially modified main part of the maintenance and recovery mechanism in FIG. 12.

In the state of FIG. 16, the cap member 110 is disposed in a manner such that the cap member 110 can surround the outer circumference of the porous member 130 having a size corresponding to an occupied area of the nozzle arrays N on the nozzle surface 34*a*1.

The porous member 130 has a function of absorbing ink remaining on the nozzle surface 34*a*1 when the porous member 130 is in close contact with the nozzle surface 34*a*1 and a function of impregnating the absorbed ink (i.e., a function of feeding the absorbed ink through the porous member 130).

The porous member 130 has a large number of space sections (e.g., small holes) inside the porous member 130. Therefore, the space sections may be used to store the collected ink. As a result, it may become possible to ensure to absorb ink even when the ink has relatively low viscosity, thereby enabling ensuring the collection of ink remaining on the nozzle surface 34*a*1 and preventing the contamination caused by the spread of the ink remained on the nozzle surface 34*a*1.

The cap member 110 and the porous member 130 are integrated (connected) with the respective actuators 140 and 150 having cylinders that can be independently extended and retracted in the direction parallel to the ink discharge direction. The actuators 140 and 150 can be controlled based on, for example, the timing when the cap member 110 is to be in close contact with the nozzle surface 34*a*1 and the timing when the porous member 130 is to be in close contact with the nozzle surface 34*a*1.

Namely, in order to suction ink remaining on the nozzle surface 34*a*1, as schematically illustrated in FIG. 16, it is controlled so that only the porous member 130 is to be in close contact with the nozzle surface 34*a*1. On the other hand, to absorb ink from the nozzle arrays N, it is controlled so that only the cap member 110 is moved towards the nozzle surface 34*a*1 so as to be in close contact with the nozzle surface 34*a*1.

When only the porous member 130 is in close contact with the nozzle surface 34*a*1, as illustrated in FIG. 16, ink remaining on the nozzle surface 34*a*1 is absorbed and suctioned into the porous member 130. On the other hand, when only the cap member 110 is in close contact with the nozzle surface 34*a*1, as illustrated in FIG. 17, ink L from the nozzle arrays N is suctioned towards the porous member 130 and further suctioned through the porous member 130 to be discharged outside.

Figure 18:
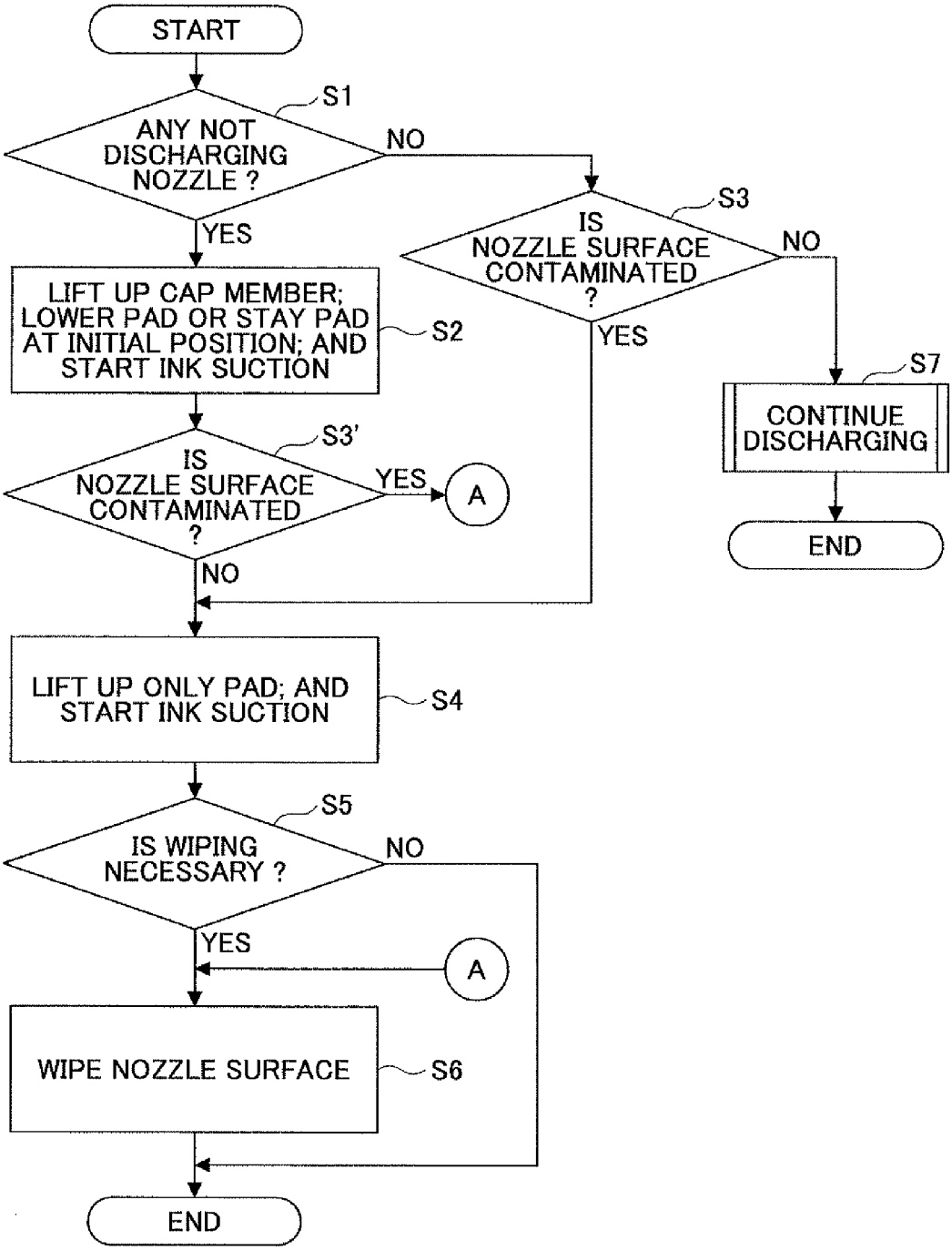
FIG. 18 is a flowchart illustrating a maintaining and recovering process in the droplet discharge apparatus according to an embodiment of the present invention.

Next, a maintaining and recovering process in the droplet discharge apparatus having the above configuration is described with reference to the flowchart of FIG. 18. In the flowchart of FIG. 18, the porous member 130 is simplified as the pad.

As illustrated in FIG. 18, a detection section (not shown) determines whether there is a nozzle through which ink is not discharged, the detection section being connected to the control section (not shown) (step S1). When determining that there is a nozzle through which ink is not discharged (YES in step S1), the actuator 140 (see FIG. 16) for the cap member 110 is driven to lift up the cap member 110 so that the cap member 110 is in close contact with the nozzle surface 34*a*1 to start absorbing ink (step S2). The absorbed ink is suctioned through the porous member 130 to be discharged outside. This state corresponds to the sate illustrated in FIG. 17.

After ink from the nozzle arrays N is suctioned while the cap member 110 is in close contact with the nozzle surface 34*a*1, the cap member 110 is separated from the nozzle surface 34*a*1. In this case, dome-shaped ink may be remained on the nozzle surface 34*a*1. Therefore, after the cap member 110 is separated from the nozzle surface 34*a*1, when it is determined that the nozzle surface 34*a*1 is contaminated (YES in step S3'), the nozzle surface 34*a*1 is wiped using the wiper 83 (see FIG. 7) (step s6).

The determination in step S3' is provided so that a compulsory wiping operation may be avoided. Namely, when determining that the nozzle surface 34*a*1 is contaminated, the compulsory wiping operation is to be performed. However, when determining that the nozzle surface 34*a*1 is not contaminated, the operation of removing ink remaining on the nozzle surface 34*a*1 is performing by suctioning without the wiping operation.

Therefore, in step S3', when determining that the nozzle surface 34*a*1 is contaminated, the actuator 150 for the pad (i.e., the porous member 130) is driven to lift up the porous member 130 so that the porous member 130 is in close contact with the nozzle surface 34*a*1 to start suctioning ink (step S4).

In step S4, after the suction operation is performed while the porous member 130 is in close contact with the nozzle surface 34*a*1, ink remaining on the nozzle surface 34*a*1 is suctioned into the porous member 130 and is further suctioned through the porous member 130 to be discharged outside. This state corresponds to the state illustrated in FIG. 16.

After ink remaining on the nozzle surface 34*a*1 is suctioned (step S4), it is determined whether it is necessary to wipe the nozzle surface 34*a*1 using the wiper 83 (steps S5). Based on that result, the wiper 83 is used to wipe the nozzle surface 34*a*1 (step S6). The determination in step S5 is made based on, for example, the number of discharging ink corresponding to a predetermining number of printing to clean the nozzle surface 34*a*1.

Further, when determined that there is no nozzle through which ink is not discharged (NO in step S1) and then when determined that the nozzle surface 34*a*1 is not contaminated (NO in step S3), the discharge operation is continued (step S7).

As described above, in the embodiments of the present invention, ink remaining on the nozzle surface 34*a*1 may be suctioned by using compulsorily generated air flows from external air independently of (besides) the ink suction from the nozzles.

Further, the element used for introducing external air has a structure that can hardly be deformed. By having the features, it may become possible to ensure to form meniscus of ink in the nozzles and prevent spread of the ink remained on the nozzle surface 34*a*1 so as to improve the print quality.

Further, in the embodiments of the present invention, when, for example, ink remaining on the nozzle surface 34*a*1 is suctioned, the cap member and/or the pad (e.g., porous member) are moved only in the direction so as to be in close contact with the nozzle surface 34*a*1, the direction being parallel to the ink discharge direction. Because of this feature, there is little dragging operation of the cap member and the pad occurred on the nozzle surface 34*a*1, which may ensure to prevent the deformation of the cap member and the pad and the degradation of the contact performance. Further, there is no element that requires the dragging operation. Because of this feature, it may become possible to improve the print quality for a longer time period with a simple structure.

Further, according to an embodiment of the present invention, there is a double structure including both the structure for suctioning ink from nozzles and the structure for suctioning ink remaining on the nozzle surface. Further, both of the structures may be disposed within a small area. Because of this feature, it may be come possible to prevent the apparatus from being enlarged.

Further, it is arranged that the suction force for suctioning ink remaining on the nozzle surface is smaller than the suction for suctioning ink from the nozzles. By arranging (setting) in this way, it may become possible to prevent the destruction of the meniscus of ink in the nozzles. Therefore, it may become possible to prevent ink from being remained on the nozzle surface caused by the ink leakage to the nozzle surface due to the destruction of the meniscus of ink.

Further, alternatively, it may become possible to prevent the destruction of the meniscus of ink in the nozzles by adequately determining (changing) the start timings to start the suction operation of suctioning ink from the nozzles and the suction operation of suctioning ink remaining on the nozzle surface and the suction rates (speeds) of the suctions operations.

Further, it may become possible to accelerate the suction operation speed in suctioning ink from the nozzles and the suction operation speed of suctioning ink remaining on the nozzle surface by adequately considering the characteristics and a recovery time of ink to be used.

According to an embodiment of the preset invention, there is provided an image forming apparatus including a droplet discharge head and a maintenance and recovery mechanism. The maintenance and recovery mechanism includes a head sealing member facing the droplet discharge head and moving to a position where a surface of the droplet discharge head is sealed off from outside of the head sealing member and a suction force generator generating a suction force inside the head sealing member to suction ink from nozzles of the droplets discharge head. Further, the head sealing member moves the droplets remaining on a nozzle surface of the droplet discharge head along the nozzle surface and suctioning the droplets.

Further, the head sealing member may include a suction port connected to the suction force generator and suctioning droplets from the droplet discharge head in a droplet discharge direction, and an air introducer introducing air along the nozzle surface of the droplet discharge head, the nozzle surface being substantially orthogonal to the droplet discharge direction.

Further, the air introducer may include slits at a rim of the head sealing member contacting the nozzle surface of the droplet discharge head.

Further, the slits are symmetrical at the rim of the head sealing member across the center of the nozzle surface of the droplet discharge head.

Further, the head sealing member may include a cap in close contact with the surface of the droplet discharge head and a pad surrounding an outer circumference of the cap, the pad having an air introducer introducing air along the nozzle surface of the droplet discharge head.

Further, the pad may be made of a porous material and in close contact with the nozzle surface of the droplet discharge head.

Further, the head sealing member may include a cap being in close contact with the surface of the droplet discharge head and suctioning droplets from a nozzle surface of the droplet discharge head and a pad different from the cap and in close contact with the nozzle surface of the droplet discharge head, and a timing to start suctioning droplet when the cap is in close contact with the surface of the droplet discharge head and a timing to start suctioning droplet when the pad is in close contact with the surface of the droplet discharge head may be changed.

Further, a suction force for moving droplets along the nozzle surface of the droplet discharge head may be smaller than a suction force for suctioning droplets from nozzles of the droplet discharge head.

According to an embodiment of the present invention, the head sealing member independently suctions droplets from the nozzles of the droplet discharge head and suctions droplets by moving droplets remaining on the surface of the droplet discharge head along the surface of the droplet discharge head. Particularly, by having the sealing member, it may become possible to perform the operation of suctioning droplets while moving droplets along the nozzle surface of the droplet discharge besides the operation of suctioning droplets from the nozzles of the droplet discharge head in the droplet discharge direction. Therefore, in addition to the suction of droplets from the nozzles, it may become possible to remove the droplets remaining on the surface of the droplet discharge head. As a result, it may become possible to reduce the contamination at and near the nozzle surface caused by droplets remaining on the surface of the droplet discharge head and effort of the wiping operation. Further, the nature of the movement of droplets from the nozzle surface of the droplet discharge head is the suction operation, that is the movement using air flow. Because of this feature, it may become possible to suction droplets regardless of the amount of droplets remaining on the surface of the droplet discharge head.

Further, according to an embodiment of the present invention, the operation of suctioning droplets from the nozzles and the operation of suctioning droplets by moving droplets along the nozzle surface are separately performed. Because of this feature, unlike the case where the operation of suctioning droplets from the nozzles and the operation of removing droplets from the nozzle surface are performed at the same time, it is not necessary to fill the area defined by the head sealing member and the nozzle surface with droplets. Because of this feature, it may become possible to reduce the droplet consumption caused by the fact that a large amount of droplets introduced into the inside of the head sealing member are unnecessarily wasted during the conventional droplet removing operation.

Further, according to an embodiment of the present invention, the movement of the head sealing member for sealing is limited to the operation to closely contact with the nozzle surface, and it is not necessary to perform slight movement of the droplet discharge head side. Because of this feature, the dragging of the head sealing member on the nozzle surface due to the slight movement may be prevented. As a result, the reduction of the sealing capability due to partial deformation of the head sealing member may be prevented, and the contamination at and near the nozzle surface due to the partial deformation, droplet leakage, and scattering of droplets and the failure of the droplet suction from the nozzles may be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a droplet discharge head;

a maintenance and recovery mechanism including:

a head sealing member facing the droplet discharge head and moving to a position where a surface of the droplet discharge head is sealed off from outside of the head sealing member; and a suction force generator generating a suction force inside the head sealing member to suction ink from nozzles of the droplets discharge head, wherein the head sealing member moves the droplets remaining on a nozzle surface of the droplet discharge head along the nozzle surface and suctioning the droplets, the head sealing member includes a cap having an upper surface, suctioning droplets from a nozzle surface of the droplet discharge head, and being in close contact with the surface of the droplet discharge head, a suction port connected to the suction force generator and suctioning droplets from the droplet discharge head in a droplet discharge direction, and an air introducer introducing air along the nozzle surface of the droplet discharge head, the nozzle surface being substantially orthogonal to the droplet discharge direction, and the air introducer includes slits at a rim of the head sealing member contacting the nozzle surface of the droplet discharge head, and wherein the slits are grooves previously formed on the upper surface of the cap.

2. The image forming apparatus according to claim 1, wherein the slits are symmetrical at the rim of the head sealing member across the center of the nozzle surface of the droplet discharge head.

3. The image forming apparatus according to claim 1, wherein the head sealing member further includes a pad surrounding an outer circumference of the cap, the cap and the pad being different members from each other, and the pad having an air introducer introducing air along the nozzle surface of the droplet discharge head.

4. The image forming apparatus according to claim 3, wherein the pad is made of a porous material and is in close contact with the nozzle surface of the droplet discharge head.

5. The image forming apparatus according to claim 1, wherein a suction force for moving droplets along the nozzle surface of the droplet discharge head is smaller than a suction force for suctioning droplets from nozzles of the droplet discharge head.

6. An image forming apparatus, comprising:

a droplet discharge head;

a maintenance and recovery mechanism including:

a head sealing member facing the droplet discharge head and moving to a position where a surface of the droplet discharge head is sealed off from outside of the head sealing member and a suction force generator generating a suction force inside the head sealing member to suction ink from nozzles of the droplets discharge head, wherein the head sealing member moves the droplets remaining on a nozzle surface of the droplet discharge head along the nozzle surface and suctioning the droplets, and wherein the head sealing member includes a cap being in close contact with the surface of the droplet discharge head and suctioning droplets from a nozzle surface of the droplet discharge head and a pad different from the cap and in close contact with the nozzle surface of the droplet discharge head, and a timing to start suctioning droplet when the cap is in close contact with the surface of the droplet discharge head and a timing to start suctioning droplet when the pad is in close contact with the surface of the droplet discharge head can be different.

7. The image forming apparatus according to claim 6, further comprising:

slits at a rim of the head sealing member, wherein the slits are symmetrical at the rim of the head sealing member across the center of the nozzle surface of the droplet discharge head.

8. The image forming apparatus according to claim 6, wherein the pad is made of a porous material.

9. The image forming apparatus according to claim 6, wherein a suction force for moving droplets along the nozzle surface of the droplet discharge head is smaller than a suction force for suctioning droplets from nozzles of the droplet discharge head.

* * * * *